US008651179B2

(12) United States Patent
Vaidya et al.

(10) Patent No.: US 8,651,179 B2
(45) Date of Patent: Feb. 18, 2014

(54) SWELLABLE DOWNHOLE DEVICE OF SUBSTANTIALLY CONSTANT PROFILE

(75) Inventors: Nitin Y. Vaidya, Missouri City, TX (US); Frederick Lemme, Sr., Katy, TX (US); Xiaohong Ren, Sugar Land, TX (US); John Whitsitt, Houston, TX (US); Joseph K. Flowers, Houston, TX (US); Rashmi Bhavsar, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 401 days.

(21) Appl. No.: 12/763,280

(22) Filed: Apr. 20, 2010

(65) Prior Publication Data

US 2011/0253393 A1 Oct. 20, 2011

(51) Int. Cl.
*E21B 33/12* (2006.01)

(52) U.S. Cl.
USPC ..... 166/179

(58) Field of Classification Search
USPC ..... 166/381, 389, 179, 387
See application file for complete search history.

(56) References Cited

U.S. PATENT DOCUMENTS

| | | | | |
|---|---|---|---|---|
| 7,373,991 | B2 | 5/2008 | Vaidya et al. | |
| 7,617,873 | B2 | 11/2009 | Lovell et al. | |
| 2006/0185849 | A1 * | 8/2006 | Edwards et al. | 166/296 |
| 2007/0056735 | A1 * | 3/2007 | Bosma et al. | 166/295 |
| 2007/0181224 | A1 | 8/2007 | Marya et al. | |
| 2008/0149345 | A1 | 6/2008 | Marya et al. | |
| 2009/0084550 | A1 * | 4/2009 | Korte et al. | 166/294 |
| 2009/0151936 | A1 | 6/2009 | Greenaway | |
| 2010/0044041 | A1 * | 2/2010 | Smith et al. | 166/280.1 |

FOREIGN PATENT DOCUMENTS

WO 2005012686 10/2005

* cited by examiner

*Primary Examiner* — Brad Harcourt
(74) *Attorney, Agent, or Firm* — David J. Groesbeck; Brandon S. Clark

(57) ABSTRACT

A swellable packer device upon exposure to brine in a well. The device may be swellable to a substantially constant profile in spite of significant fluctuations in brine concentrations. Thus, the likelihood of packer failure due to under-swelling or over-swelling is reduced. Indeed, the packer may be employed for long-term operations or isolations ranging from a couple of weeks to twenty years or more without undue concern over packer failure from under or over swelling.

14 Claims, 5 Drawing Sheets

SWELLABLE DOWNHOLE DEVICE OF SUBSTANTIALLY CONSTANT PROFILE

FIELD

Embodiments described relate to swellable devices or parts for use downhole in a well. In particular, swellable packers are disclosed which are configured to provide a sealing engagement relative to the well. Whether in packer form or otherwise, devices and device parts detailed herein may be configured to swell upon exposure to a water-based fluid such as brine containing water. Additionally, such devices and/or parts are configured to remain substantially constant in overall swell profile, irrespective of significant variations in brine or saline concentrations in the water-based fluid.

BACKGROUND

Exploring, drilling and completing hydrocarbon and other wells are generally complicated, time consuming, and ultimately very expensive endeavors. As a result, over the years, a significant amount of added emphasis has been placed on well monitoring and maintenance. Once more, perhaps even more emphasis has been directed at initial well architecture and design. All in all, careful attention to design, monitoring and maintenance may help maximize production and extend well life. Thus, a substantial return on the investment in the completed well may be better ensured.

In the case of well monitoring and logging, mostly minimally-invasive applications may be utilized which provide temperature, pressure and other production related information. By contrast, well design, completion and subsequent maintenance, may involve a host of more direct interventional applications. For example, perforations may be induced in the wall of the well, debris or tools and equipment removed, etc. In some cases, the well may even be designed or modified such that entire downhole regions are isolated or closed off from production. Such is often the case where an otherwise productive well region is prone to produce water or other undesirable fluid that tends to hamper hydrocarbon recovery.

Closing off well regions as noted above is generally achieved by way of setting one or more inflatable packers. Such packers may be set at downhole locations and serve to seal off certain downhole regions from other productive regions. Delivering, deploying and setting packers for isolation may be achieved by way of coiled tubing, or other conventional line delivery application. The application may be directed from the oilfield surface and involve a significant amount of manpower and equipment. Indeed, the application may be fairly sophisticated, given the amount of precision involved in packer positioning and inflation. Proper packer inflation, in particular may be quite challenging, given the high and variable temperature and pressure extremes often present downhole which can affect fluid inflation.

In order to avoid the significant challenges associated with setting packers via inflation, packers may be configured for setting via swelling. That is, rather than equipped with an internal bladder for inflation, a packer may be more monolithic in nature and of a material configured to swell upon exposure to certain downhole conditions. Often, the packers may be of material configured to expand or 'swell' upon exposure to water-based fluid such as water, brine or other saline containing water. So, for example, an un-deployed swell packer may be positioned at a downhole location for isolation as alluded to above. Thereafter, usually over the course of between a few hours and a few days, the swell packer may swell and set into a sealing engagement with the well at the noted downhole location. Generally, by the time the packer is fully set, a profile is attained that is two to three times that of the packer in its original un-deployed state.

The above described packer, like other swellable devices, takes the form of a swellable fixture in the well. That is, as opposed to briefly introduced interventional tool, a packer is generally employed on a long-term basis. Even where the packer is utilized for temporary isolation, it is unlikely that the packer would be employed for less than a week. Once more, it is much more likely that the packer is set in place to maintain an isolation for the life of the well, which is often greater than 20 years in duration. Unfortunately, the reliability of the swell packer in terms of remaining adequately set over the long-term is less than desirable. Indeed, due to fluctuations in brine or salt concentration of the water-based fluid, the performance of the swell packer may also be quite variable as described below.

Swell packers as described above are generally of elastomers specially configured to swell in the presence of brine. As used herein, the term brine is meant to refer to any water-based fluid containing a measurable concentration of a salt such as sodium chloride. Unfortunately, the swelling character of the elastomers employed is variable in relationship to the variability in salt concentration of the brine. That is, as the salt concentration increases, so to does the amount of swell. So, for example, as concentration moves from 1% to 5%, the expansion ratio of the swell packer may dramatically increase (e.g. generally by more than about 75% in overall attained profile).

In order to address performance variability in the swell packer, extra effort may be placed on profiling and/or estimating downhole salt concentration in combination with careful selection of packer dimension and elastomer choice. However, such efforts fail to account for the long-term nature of the packer deployment. That is, with a likely deployment of between a week and up to twenty years or more, the odds of significant changes in downhole salt concentration are nearly guaranteed. As a result, the risk of packer failure due to shrinkage or over expansion and degradation is almost just as likely. Indeed, at present, follow-on costly interventional applications, such as cementing or additional packer deployments, are often required to remedy swell packer failure in downhole well locations of volatile salt concentrations.

SUMMARY

A swellable downhole device is disclosed for deployment in a well. The device is of a material configured to swell to a given degree upon exposure to brine in the well. Additionally, the given degree of swell for the material remains substantially constant where the brine concentration is below about 10%.

DETAILED DESCRIPTION

Embodiments herein are described with reference to certain types of downhole swellable fixtures. For example, these embodiments focus on the use of packers for isolating certain downhole regions in conjunction with the use of production tubing. However, a variety of alternative applications may employ such swellable packers, such as for well stimulation, completions, gravel packing, or isolation for water injection. Additionally, alternative swellable fixture types, such as plugs, chokes, flow control valves and restrictors may take advantage of materials and techniques disclosed herein. Regardless, embodiments of downhole swellable fixtures disclosed herein are configured to remain of a substantially constant profile upon exposure to variable brine concentrations in the well.

As used herein, the term 'brine' is meant to refer to any water-based fluid containing salt such as sodium and/or sodium chloride. Additionally, this patent document has been filed in conjunction with U.S. patent application Ser. No. 12/799,153 filed on Apr. 20, 2010 and entitled "Expandable Elastomeric Material in the Presence of Water or Oil," which may be utilized in construction of embodiments of downhole swellable fixtures and is incorporated herein by reference in its entirety.

Figure 1A:
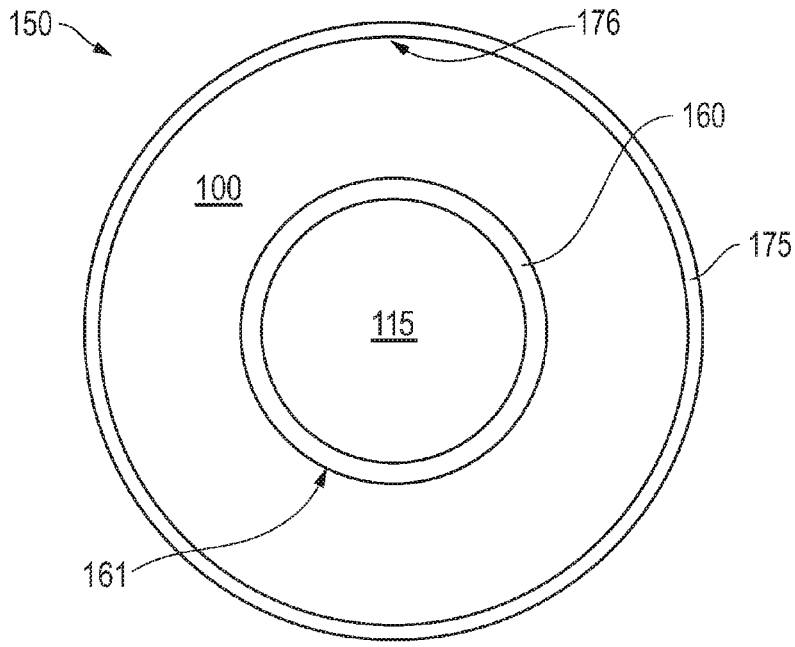
FIG. 1A is a front cross-sectional view of an embodiment of a swellable fixture in the form of a packer for isolating and securing tubing at a location in a well.

Referring now to FIG. 1A, a front cross-sectional view of an embodiment of a swellable fixture in the form of a packer 100 is shown. The packer 100 is disposed in a well 150 defined by a conventional casing 175. In this embodiment, the packer 100 is oriented in a manner that secures tubing 160 at a location in a well 150. This tubing 160 provides a pathway 115 to allow passage of a hydrocarbon flow 250 from one side of the packer 100 to the other (i.e. such as production tubing (see FIGS. 2 and 3)).

It is of particular note, that the packer 100 is swollen to provide durable sealing engagements with both the packer-tubing interface 161 and the packer-well wall interface 176. Indeed, as detailed below, the packer 100 is configured of materials thoroughly detailed in the co-pending patent document identified above in paragraph 0020. Thus, in spite of potentially significant variability in downhole brine concentration, the packer 100 is configured to remain of a substantially constant profile. More specifically, upon exposure to brine, the packer 100 is configured to swell to a given degree of between about 50% and 250% over and above its pre-swollen size, limited only by the surrounding structural restriction of the inner diameter of the well 150. Furthermore, the packer 100 is constructed of materials such that the achieved profile, or given degree to which the packer 100 is swollen, varies by no more than about 30% so long as the brine concentration remains less than about 10%.

Such percentages roughly correspond with a typical downhole brine exposure, particularly outside of operations likely to encounter seawater. Regardless, whether the brine concentration downhole is 2% or 8%, the affect on the achieved profile differs by no more than about 30%. Thus, given the compressible elastomeric nature of the packer materials as detailed throughout the co-pending patent document identified above in paragraph 0020, it is accurate to characterize the swollen packer 100 as of a substantially constant profile.

Figure 1B:
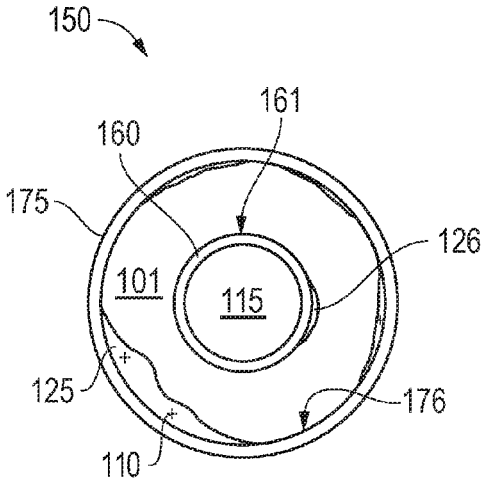
FIG. 1B (Prior Art)
FIG. 1B is a front cross-sectional view of a prior art packer displaying failure of isolating and securing due to under-swelling.
Figure 1C:
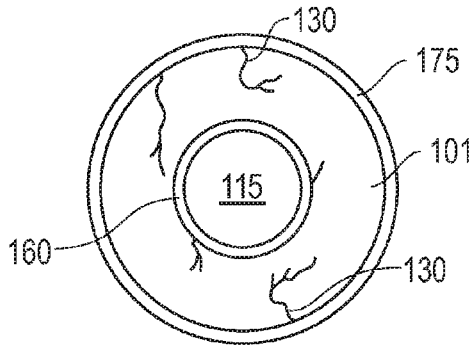
FIG. 1C (Prior Art)
FIG. 1C is a front cross-sectional view of a prior art packer displaying degradation due to over-swelling.

By way of comparison to the substantially constant profile of the packer 100 of FIG. 1A, FIGS. 1B and 1C reveal a prior art packer 101 that is not of a substantially constant profile in the face of fluctuating downhole brine concentrations. Indeed, FIG. 1B reveals a prior art packer 101 displaying failure of isolating and securing due to under-swelling whereas FIG. 1C reveals the packer 101 displaying degradation due to over-swelling as described further below.

With specific reference to FIG. 1B, the prior art packer 101 is configured similar to embodiments described herein. Namely, the prior art packer 101 is configured to begin swell upon exposure to brine 110 (represented by + symbols). However, unlike embodiments described herein, the materials employed for the prior art packer 101 are significantly affected by the concentration of brine 110. So, for example, where the packer 101 is exposed to a low concentration of brine, say below about 2%, swelling may be induced. However, as shown, such swelling may be insufficient to form complete durable sealing engagements with the packer-tubing interface 161 and the packer-well wall interface 176. Indeed, as shown in FIG. 1B, the packer 101 fails to completely seal and isolate the tubing 160 (see 126) and a portion of and the annular space 125 of the well 150 remains open. Furthermore, as described below, tailoring prior art material choices for greater swelling upon exposure to such low concentration brine 110 may also be problematic.

With specific reference to FIG. 1C, the prior art packer 101 may be configured of conventional materials selected to swell to a greater degree upon exposure to lower concentrations of brine 110 such as the above noted 2% or less. Unfortunately, however, conventional swellable materials are dramatically affected by fluctuations in brine concentration. So, for example, where such concentrations become high, say above about 5%, an otherwise properly swollen packer 101, at 2% or less brine concentration, is now over-swollen by 75% or more, limited only by the inner diameter or the casing 175. Indeed, degradation due to such over-swelling may be seen at the cracking 130 which emanates from the solid adjacent structures of the casing 175 and tubing 160. Ultimately, due to natural fluctuations in brine concentration, such a prior art packer 101 is unlikely to remain effective for isolation on a long-term basis (i.e. two weeks or longer).

Referring again to FIG. 1A, the packer 100 is of swellable elastomers that are less affected by fluctuations in brine concentration. Thus, long-term effectiveness of the packer 100 is enhanced. As described in the co-pending patent document identified above in paragraph 0020, the elastomers employed in the packer 100 may be natural rubber or synthetic elastomers mixed or compounded with particles of a polymer. More specifically, such polymer particles may be drawn from a betaine group prepared by inverse emulsion polymerization. Additional fillers and vulcanizing agents and other substances may be incorporated into elastomer as detailed in the noted co-pending application. Ultimately, the elastomer backbone of the brine swellable material may be tailored with particular concentrations of cations and/or anions grafted thereto so as to reduce the sensitivity thereof to brine concentration. As a result, a packer 100 may be constructed that is swellable in the presence of brine but with a resultant swell profile that is of a reduced sensitivity the actual concentration of brine in the well 150.

The elastomer base material for the packer 100 may also include non-elastomeric polymers and be constructed in a variety of configurations. For example, different non-elastomer and elastomer layers may be individually provided of varying thicknesses. Such layers may be stacked or of interpenetrating networks. Further, the elastomer composition itself may include fillers, plasticizers, accelerants and various fibers. Additionally, non-elastomeric polymer choices may include thermoplastic polymers, such as polyolefins, polyamides, polyesters, thermoplastic polyurethanes and polyurea urethanes, copolymers and blends thereof and/or thermoset polymers such as phenolic and epoxy resins.

Figure 2:
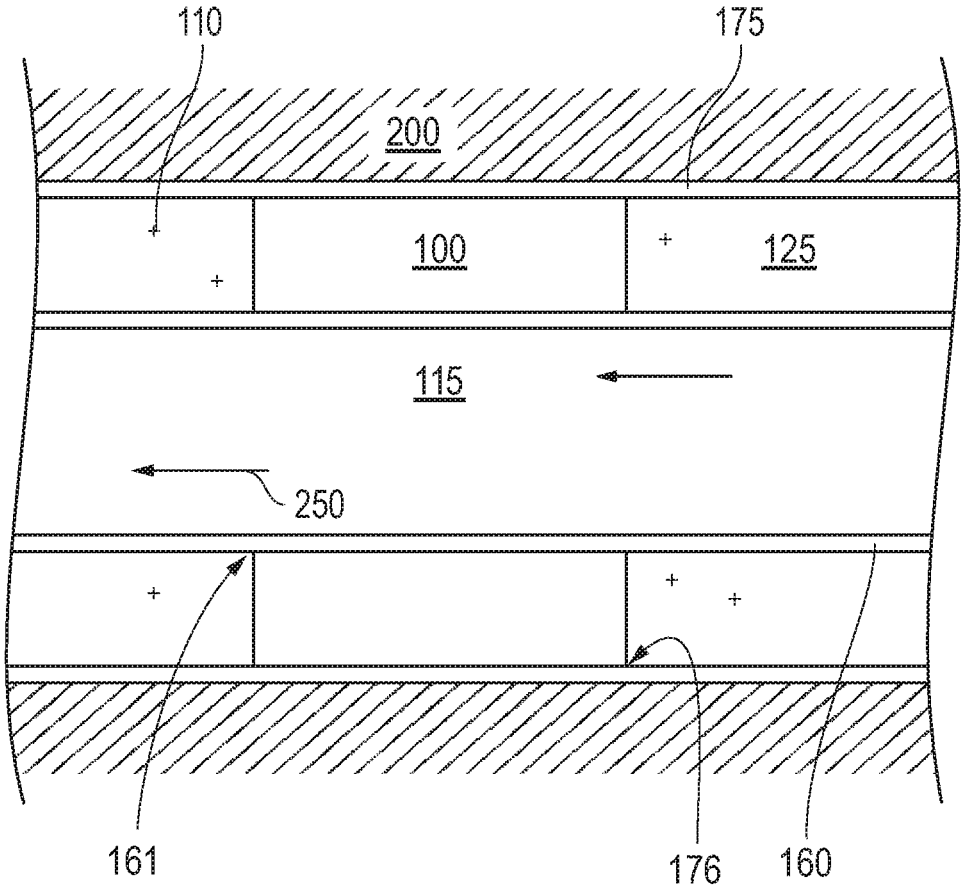
FIG. 2 is a side cross-sectional view of the packer of FIG. 1A isolating and securing the tubing in the well.

Referring now to FIG. 2, a side cross-sectional view of the packer 100 of FIG. 1A is shown. In this view, the swelling nature of the packer 100 is apparent. That is, as the packer 100 is exposed to brine 110 in the annulus 125 interior of the casing 175, swelling takes place. Thus, the packer 100 is swollen into sealing engagement with both the packer-tubing interface 161 and the packer-well wall interface 176. Once exposed to the brine 110, such swelling may take place over the course of a couple of days to a couple of months depending upon the particular material composition of the packer 100.

In the depiction of FIG. 2, a hydrocarbon flow 250 is shown which emanates from the surrounding formation 200 and travels through the pathway 115 of the tubing 160. Additionally, brine 110 is shown at either side of the packer 100 but outside of the hydrocarbon flow 250 and pathway 115. In other words, with added reference to FIG. 3 detailed below, the swelling of the packer 100 may be employed to help isolate the brine 110 or brine producing region 300 of the well 150 from production operations.

Figure 3:
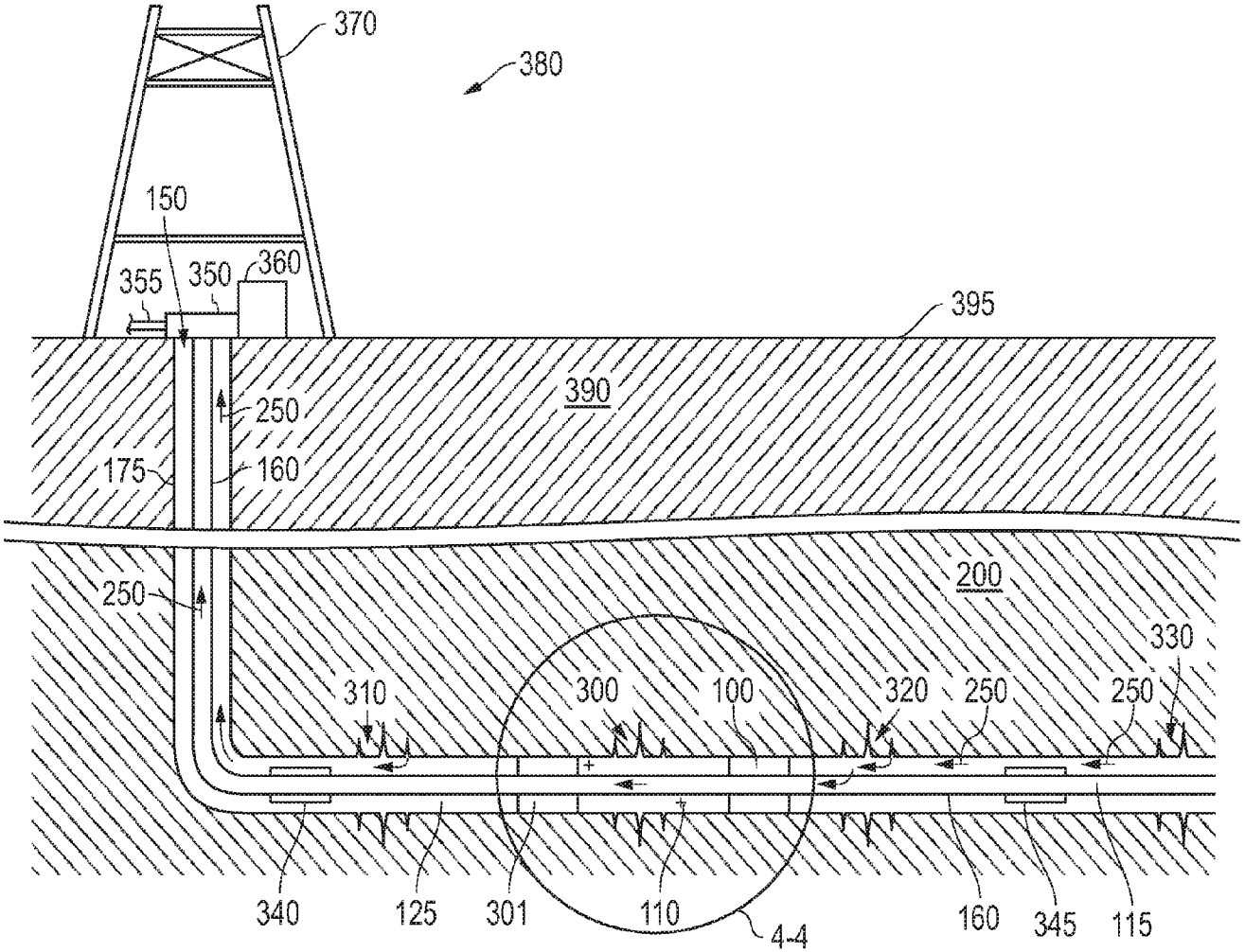
FIG. 3 is an overview of an oilfield accommodating the well of FIG. 1A with the packer and another adjacent packer employed for securing the tubing and isolating a downhole region.

Referring now to FIG. 3, an overview of an oilfield 395 is shown whereat the well 150 of FIG. 1A is accommodated. Within the well 150, the packer 100 is fully swollen along with another adjacent packer 301. As such, the tubing 160 is secured at the above noted brine producing region 300. However, perhaps more notably, the brine producing region 300 itself is isolated by the indicated packers 100, 301 as described further below.

Continuing with reference to FIG. 3, the depicted well 150 traverses various formation layers 200, 390 and ultimately a host of regions 300, 310, 320, 330 from which hydrocarbons may be drawn. Indeed, as described above, a hydrocarbon flow 250 may be drawn from some of these regions (see 320, 330). In the embodiment shown, the hydrocarbon flow 250 may initially be drawn into the annulus 125 of the well 150 and the pathway 115 of the production tubing 160 (via casing 475 and tubing 450 perforations (see FIGS. 4A-4C)). So long as the packers 100, 301, 340, 345 are exposed to oil based fluids such as the noted flow 250, they may remain in an unswollen state (see packers 340, 345).

By the same token, however, brine 110, which may dramatically hamper hydrocarbon recovery efforts, may also be produced (see region 300). Therefore, in the embodiment depicted, the production tubing 160 is equipped with pre-positioned unswollen brine swellable packers 100, 301, 340, 345. Thus, as packers 100, 301 straddling either side of a brine producing region 300 are exposed to brine 110, a completed swelling may take place so as to isolate the annulus 125 of the well 150 therebetween. Furthermore, as described below with reference to FIG. 4C, a sliding sleeve 400 may be employed to halt the influx of brine 110 into the pathway 115 of the tubing 160.

As a result of the depicted assembly of FIG. 3, hydrocarbon flow 250 produced downhole of the brine producing region 300 may be transferred uphole through the tubing 160 and past the region 300 without any substantial brine contamination. Once more, as detailed above, the substantially constant profile of the swollen packers 100, 301, allows for the isolation of the region 300 to be reliably maintained over the long-term without undue concern over packer failure.

Continuing with reference to FIG. 3, an overall production assembly is depicted which takes advantage of the swellable downhole device embodiments described herein. The assembly includes the noted well 150, tubing 160, and appropriately located packers 100, 301, 340, 345 as indicated. Additionally, a host of surface equipment 380 is positioned at the oilfield 395 for management of the assembly and produced hydrocarbon flow 250. Namely, a rig 370 is provided which may serve as a platform for a variety of well interventional and control mechanisms. As shown, a well head 350 for interfacing the well 150 and tubing 160 at the surface is positioned below the rig 370. A surface production line 355 is depicted running from the head 350 for delivery of produced fluids. The line 355 may be coupled to various pumps or a variety of other equipment to aid in recovery. Additionally, a control unit 360 for directing recovery efforts is shown depicted adjacent the well head 350. For example, the unit 360 may direct the shifting of a sliding sleeve 400 as alluded to above and depicted in FIGS. 4A-4C described below.

Figure 4A:
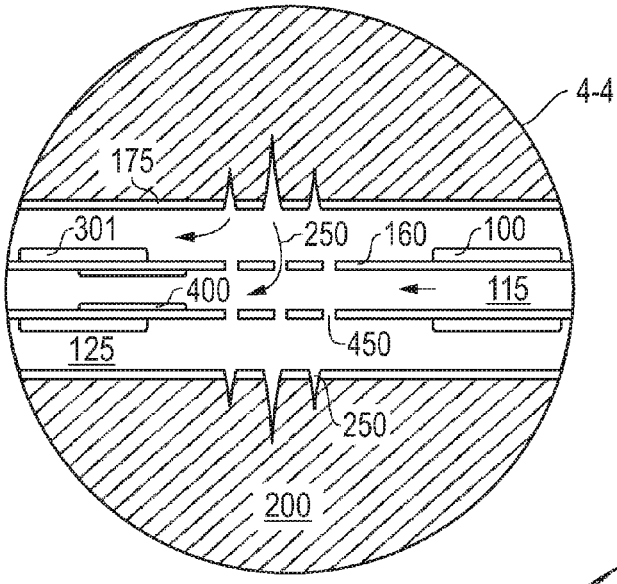
FIG. 4A is a side view of the downhole region taken from 4-4 of FIG. 3 with the packers in an unswollen state about the tubing.
Figure 4B:
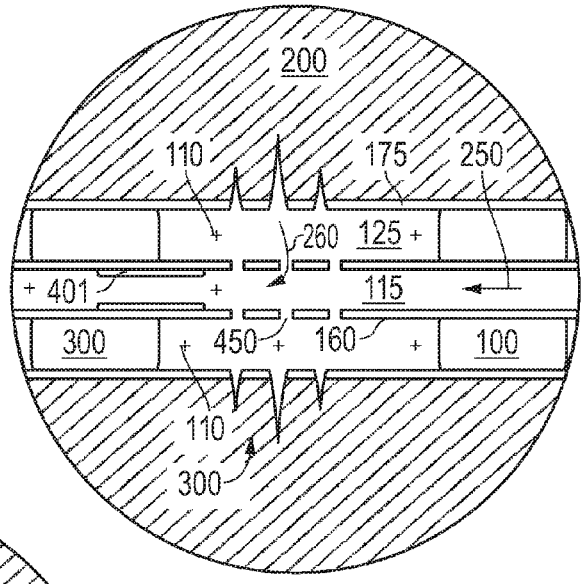
FIG. 4B is a side view of the downhole region with the packers of FIG. 4A in a fully swollen state securing the tubing.
Figure 4C:
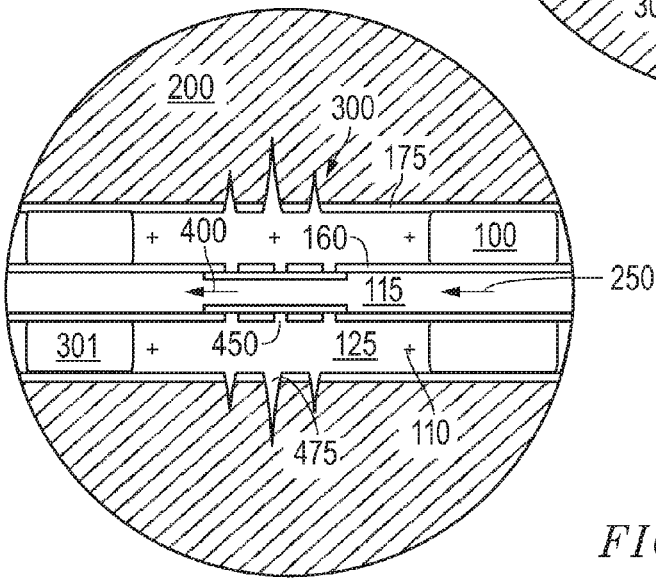
FIG. 4C is a side view of the downhole region with a sliding sleeve of the tubing of FIG. 4B shifted for completing the isolation.

Referring now to FIGS. 4A-4C, an enlarged view of the brine producing region 300 is shown taken from 4-4 of FIG. 3. FIG. 4A, in particular is a side view of the region 300 with the packers 100, 301 in an unswollen state about the tubing 160. With the packers 100, 301 unswollen, production flow 250 may take place through the annulus 125. However, such flow 250 may also proceed through the pathway 115 of the tubing 160 via tubing perforations 450 as noted above.

Referring now to FIG. 4B, the region 300 may be subject to producing brine 110 as described with reference to FIG. 3. Thus, as also depicted in FIG. 3, exposure of the brine swellable packers 100, 301 to brine 110 leads to complete swell thereof. Due to unique material construction as detailed above, the profile of the packers 100, 301 upon exposure to the brine 110 remains substantially constant even in the face of fairly significant fluctuations in brine concentration. Thus, sealing engagement with the tubing 160 and the casing 175 remains effective over the long-term. As a result, the annulus 125 of the region 300 and brine 110 thereat is isolated.

While brine 110 in the annulus 125 is isolated as described above, the pathway 115 of the tubing 160 remains subject to brine exposure via the tubing perforations 450. Thus, as depicted in FIG. 4C, a sliding sleeve 400 may be shifted to close off the perforations 450 and halt the production of brine 110 through the pathway. This may be directed through the unit 360 of FIG. 3 via conventional sleeve shifting techniques. For example, a sleeve shifting tool may be deployed through the tubing 160 from surface and directed by the unit 360 as indicated. Regardless, the tubular nature of the sleeve 400 allows for the continued production of hydrocarbon flow 250 from regions 320, 330 downhole of the brine producing region 300 even upon closing off of the perforations 450 (see FIG. 3).

Figure 5:
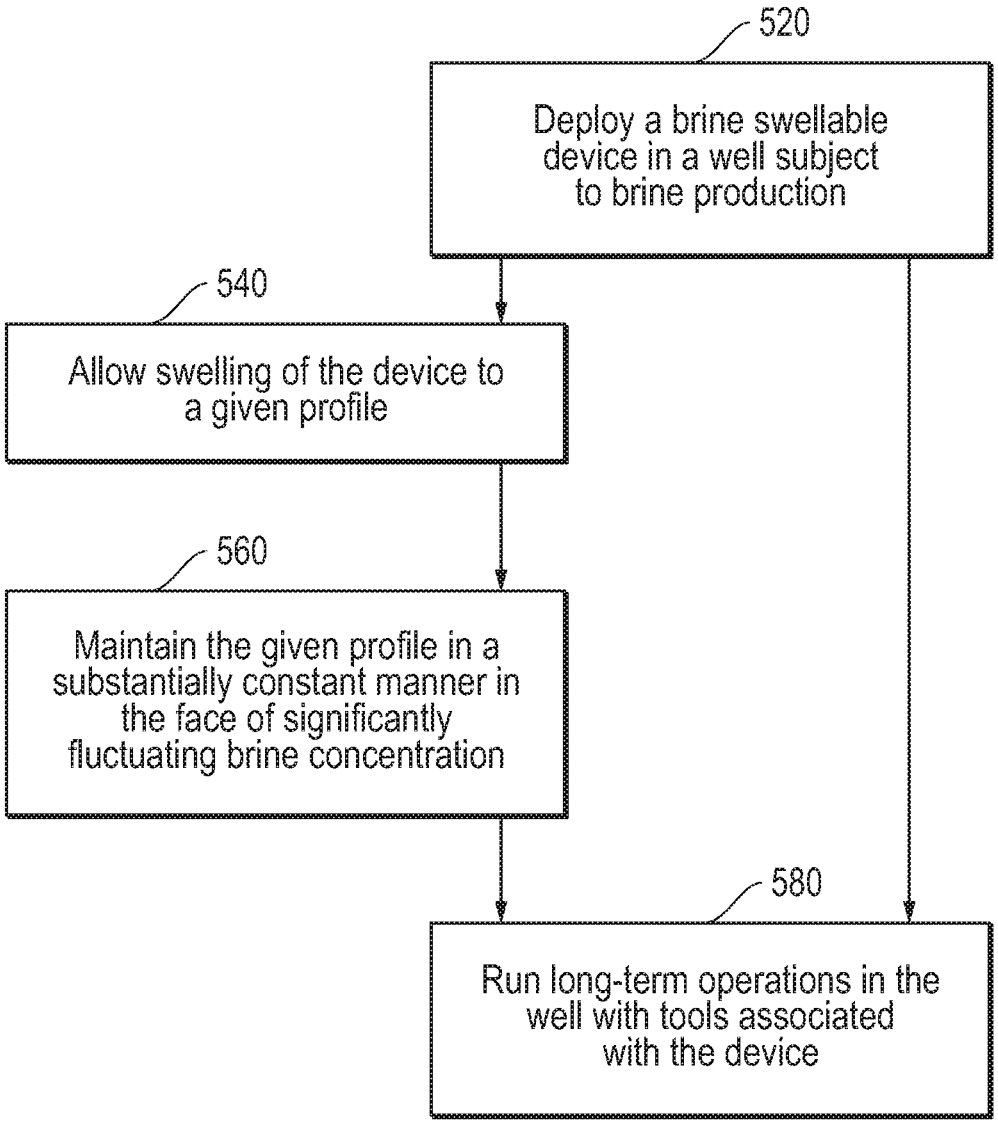
FIG. 5 is a flow-chart summarizing an embodiment of deploying a swellable packer of substantially constant profile in a well subject to containing brine.

Referring now to FIG. 5, a flow-chart is shown summarizing an embodiment of deploying a swellable device of in a well subject to containing brine. Following deployment as indicated at 520, the device, such as an above described packer, may be swollen to a given profile upon exposure to brine (see 540). Nevertheless, as indicated at 560, the profile may be maintained in a substantially constant manner, even in the face of fairly significant fluctuations in brine concentration. So, for example, downhole brine producing regions may be effectively isolated as described hereinabove.

As a result of the substantially constant profile of the swollen device, long-term operations may be run in the well with tools coupled or associated with the device without undue concern over device failure from over or under-swelling (see 580). For example, production operations may proceed as described herein without concern over packer failure leading to brine production and ultimately ineffective hydrocarbon recovery. Of course, as also depicted in the chart of FIG. 5, an assembly may take advantage of the benefits of brine swellable devices as a precautionary measure. That is, such swellable devices may be outfitted on such a downhole assembly as described herein and, should brine production ultimately fail to present, long-term operations may nevertheless proceed unaffected (see 520 and 580).

Embodiments described hereinabove provide brine swellable devices that are swellable to a given profile that is largely unaffected by fluctuations in brine concentration. The elastomers employed allow for the maintenance of a substantially constant profile in the face of exposure to varying brine concentrations in the well. As a result, such devices may effectively serve as downhole packers for long-term use. Thus, the need for costly follow-on interventional applications such as cementing or subsequent packer deployment is largely eliminated.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. Furthermore, the foregoing description should not be read as pertaining only to the precise structures described and shown in the accompanying drawings, but rather should be read as consistent with and as support for the following claims, which are to have their fullest and fairest scope.

We claim:

1. A swellable downhole device for deployment in a well subject to brine production, the device of a material of betaine group polymer particles configured to swell to a given degree upon exposure to the brine and with a sensitivity thereto tailored by an incorporated concentration of anions, the given degree to remain substantially constant where a concentration of the brine is less than about 10%.

2. The swellable downhole device of claim 1 wherein the substantially constant degree of swell includes an overall profile variability for the material of no more than about 30%.

3. The swellable downhole device of claim 1 wherein the given degree is between about 50% and about 250% in overall profile.

4. The swellable downhole device of claim 3 wherein the overall profile is limited by interfacing a surrounding structural restriction.

5. The swellable downhole device of claim 4 wherein the restriction is an inner diameter of the well.

6. The swellable downhole device of claim 5 wherein the interfacing forms an effective long-term sealing engagement.

7. The swellable downhole device of claim 1 in the form of a downhole fixture selected from a group consisting of a packer, a plug, a choke, a restrictor, and a flow control valve.

8. The swellable downhole device of claim 1 wherein the polymer particles are compounded into one of a natural rubber, a synthetic elastomer, and a non-elastomeric polymer.

9. The swellable downhole device of claim 8 wherein the non-elastomeric polymer is one of a thermoplastic polymer, a thermoplastic polyurethane, polyurea urethane, and a thermoset polymer.

10. The swellable downhole device of claim 8 wherein the material further comprises one of a filler and a vulcanizing agent.

11. A method comprising:

disposing a brine swellable packer in a well subject to brine production; and running an operation in the well with a tool coupled to the packer, the packer of a material configured to swell to a substantially constant overall profile upon long-term exposing thereof to a significantly fluctuating concentration of the brine, the material of a sensitivity to the brine tailored by an incorporated concentration of anions.

12. The method of claim 11 wherein the operation is one of production, stimulation, completion, gravel packing, and water injection.

13. The method of claim 11 further comprising:

swelling the packer into sealing engagement with the well upon the exposing; and effectively maintaining the engagement long-term.

14. The method of claim 13 wherein the operation is production and the tool is production tubing, the method further comprising producing a hydrocarbon flow through the tubing from downhole of the packer to uphole thereof during said maintaining.

* * * * *